US012114791B2

(12) United States Patent
Sullivan

(10) Patent No.: US 12,114,791 B2
(45) Date of Patent: Oct. 15, 2024

(54) HORIZONTAL KNIFE HOLDER

(71) Applicant: Hollywood Chairs, Carlsbad, CA (US)

(72) Inventor: Tom Sullivan, San Marcos, CA (US)

( * ) Notice: Subject to any disclaimer, the term of this patent is extended or adjusted under 35 U.S.C. 154(b) by 15 days.

(21) Appl. No.: 18/138,427

(22) Filed: Apr. 24, 2023

(65) Prior Publication Data

US 2023/0337844 A1 Oct. 26, 2023

Related U.S. Application Data

(60) Provisional application No. 63/334,269, filed on Apr. 25, 2022.

(51) Int. Cl.
*A47G 21/14* (2006.01)
*A47B 88/988* (2017.01)

(52) U.S. Cl.
CPC ..... *A47G 21/14* (2013.01); *A47B 88/988* (2017.01)

(58) Field of Classification Search
CPC ..... A47G 21/14; A47B 88/988
USPC ..... 211/70.6, 70.7
See application file for complete search history.

(56) References Cited

U.S. PATENT DOCUMENTS 72,009 A * 12/1867 Oviatt ..... A47G 21/14 248/37.3
200,083 A * 2/1878 Foster ..... A24F 19/0014 D6/569
2,636,615 A * 4/1953 Bradley ..... B43K 23/04 211/69.8
3,182,808 A * 5/1965 Benoit ..... B43K 31/00 211/69.8
3,915,213 A * 10/1975 Graham, Jr. ..... A47G 21/14 206/553
4,305,629 A * 12/1981 Friis ..... A47B 88/988 248/37.3
4,575,939 A * 3/1986 Buchtel ..... A47G 21/14 248/37.3
5,201,430 A * 4/1993 Artzer ..... A47G 21/14 206/370
5,738,228 A * 4/1998 Bittinger ..... A47F 7/0021 211/60.1
6,082,559 A * 7/2000 Levsen ..... B65D 25/10 248/37.3
7,303,493 B1 * 12/2007 Ehresman ..... A63B 57/10 473/386
8,464,868 B2 * 6/2013 Kruger ..... A47B 88/994 206/362.1
8,905,825 B2 * 12/2014 Huff ..... B24D 15/081 451/344
10,251,500 B2 * 4/2019 Marcu ..... A47G 21/14
(Continued)

FOREIGN PATENT DOCUMENTS

CH 684052 A5 * 7/1994 ..... A47G 21/14
DE 3631690 A1 * 3/1988 ..... A47G 21/14
(Continued)

*Primary Examiner* — Stanton L Krycinski
(74) *Attorney, Agent, or Firm* — Eric Hanscom

(57) ABSTRACT

A horizontal knife holder is a tray that can be used in a kitchen drawer or outside. The holder has two sides, a back, a bottom, a scalloped front, and a top portion that covers the back of the tray. Under the top portion is a plastic wire brush with a large number of stiff bristles, into which knives can be removably inserted. The tray has a soft bottom to protect users' knuckles, and the scalloped front allows for easy access to the knives.

7 Claims, 6 Drawing Sheets

(56) References Cited

U.S. PATENT DOCUMENTS

| | | | | |
|---|---|---|---|---|
| 10,390,661 | B1 * | 8/2019 | Steingraber | A47G 21/14 |
| 11,135,714 | B1 * | 10/2021 | Willis | B25H 3/00 |
| 2006/0218798 | A1 * | 10/2006 | Chen | A47G 21/14 30/298 |
| 2016/0367055 | A1 * | 12/2016 | Rausch | B65D 21/0204 |
| 2017/0143143 | A1 * | 5/2017 | Kindley | A47G 21/14 |
| 2023/0210259 | A1 * | 7/2023 | Tontarelli | A47B 88/988 211/70.7 |

FOREIGN PATENT DOCUMENTS

| | | | | |
|---|---|---|---|---|
| EP | 2742831 | A1 * | 6/2014 | A47G 21/14 |
| GB | 2316857 | A * | 3/1998 | A47G 21/14 |

* cited by examiner

HORIZONTAL KNIFE HOLDER

CROSS REFERENCE TO RELATED APPLICATIONS

This utility patent application claims priority back to U.S. Provisional Application No. 63/334,269, with a filing date of Apr. 25, 2022, the contents of which are incorporated by reference into this utility patent application.

STATEMENT REGARDING FEDERALLY SPONSORED RESEARCH OR DEVELOPMENT

This invention was not federally sponsored.

BACKGROUND OF THE INVENTION

Field of the Invention

This invention relates to a general field of knife storage devices, and more specifically, to a horizontal knife holder that retains knives through use of a horizontal wire brush.

Brief Description of Invention

The horizontal knife holder is a tray-like structure with two sides, and end, a bottom, a scalloped front, and a top that covers the back portion of the tray and serves as a knife guard. Under the top is a horizontally-aligned, wire brush, which allows a user to slide knives in between the numerous wire bristles.

Storage of knives has long created problems in the kitchen. There are knife blocks made for storage of knives outside of a kitchen drawer, but there are usually vertically aligned or at least partially vertically aligned. There are also knife storage trays that fit into kitchen drawers, but these usually let the knives move around freely, leading to a quick dulling of the knife edges.

Thus, there has existed a long-felt need for a good way to store knives horizontally. The current invention provides just such a solution by having a horizontal knife holder that is basically a tray that can be used in a kitchen drawer or outside. The holder has two sides, a back, a bottom, a scalloped front, and a top portion that covers the back of the tray. Under the top portion is a wire brush with a large number of stiff bristles, into which knives can be removably inserted. The bristles are preferably made from a rigid plastic, but other materials, including metal, are contemplated. The tray has a soft bottom to protect users' knuckles and provides for minimal scarring of the product, while the scalloped front allows for easy access to the knives.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

REFERENCE NUMBERS USED

Figure 1:
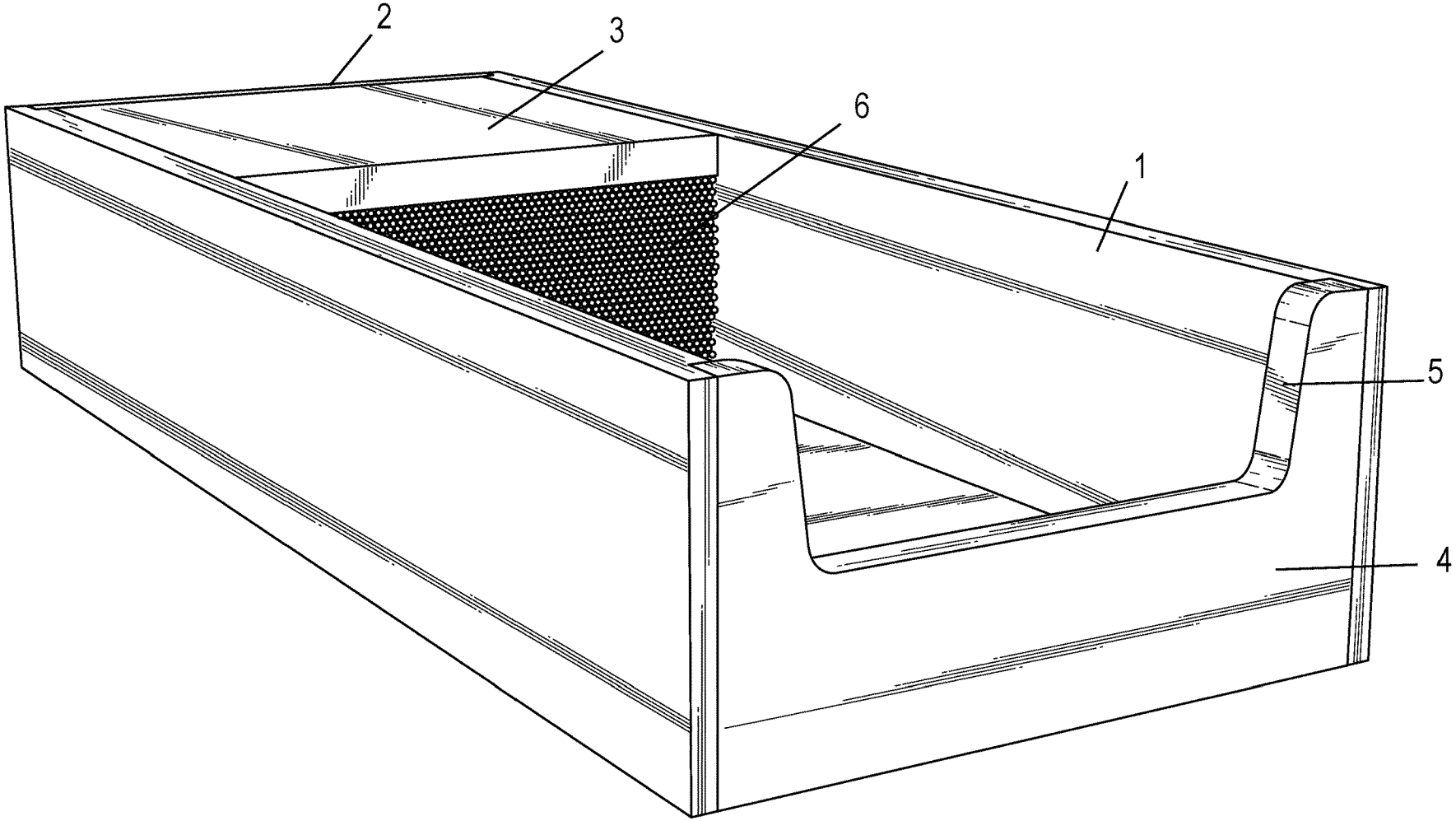
FIG. 1 is a perspective view of a horizontal knife holder.

1. Side
2. Back
3. Top
4. Front
5. Scalloped portion
6. Holder
7. Bottom

DETAILED DESCRIPTION OF THE FIGURES

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Figure 2:
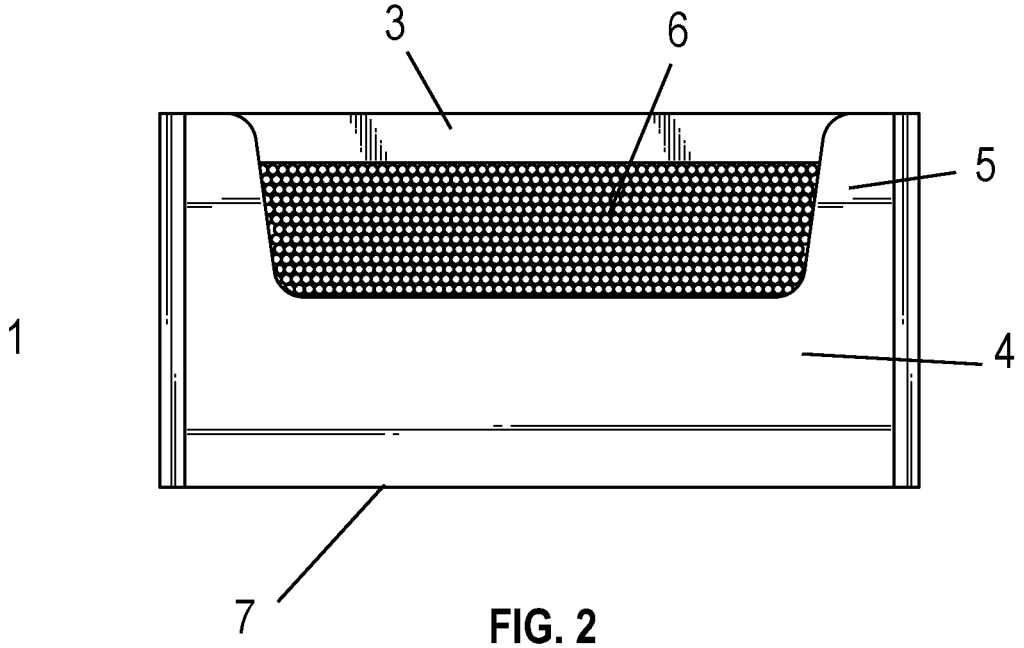
FIG. 2 is a front view thereof.
Figure 3:
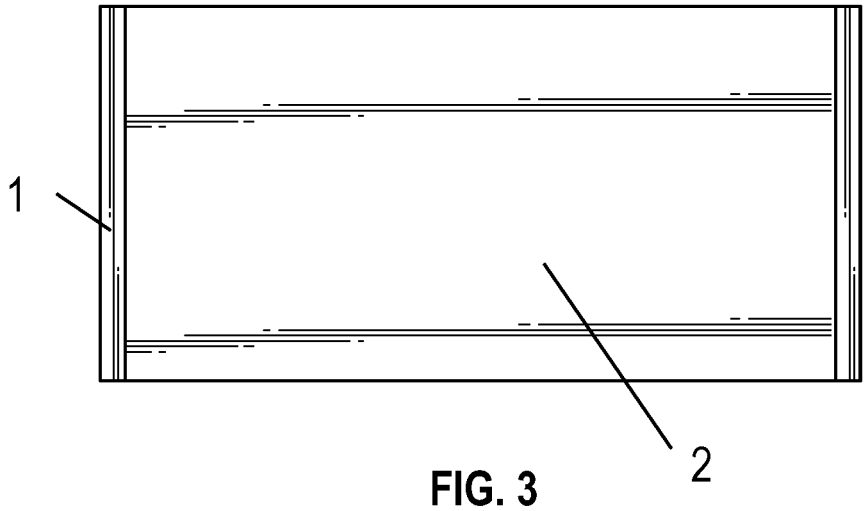
FIG. 3 is a back view thereof.
Figure 4:
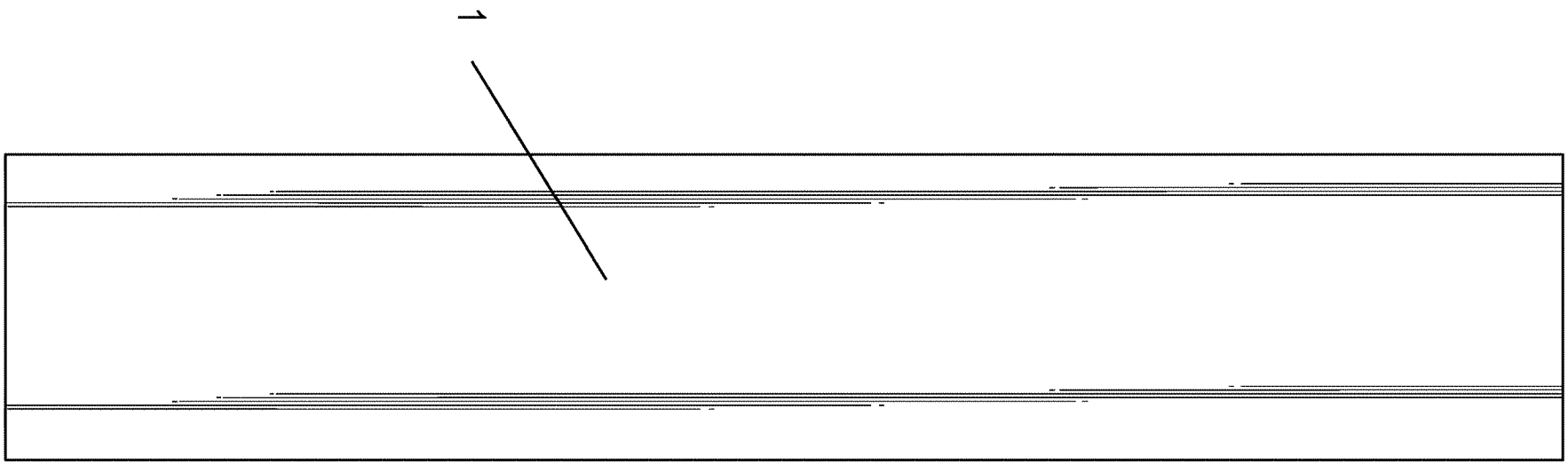
FIG. 4 is a left-side view thereof.
Figure 5:
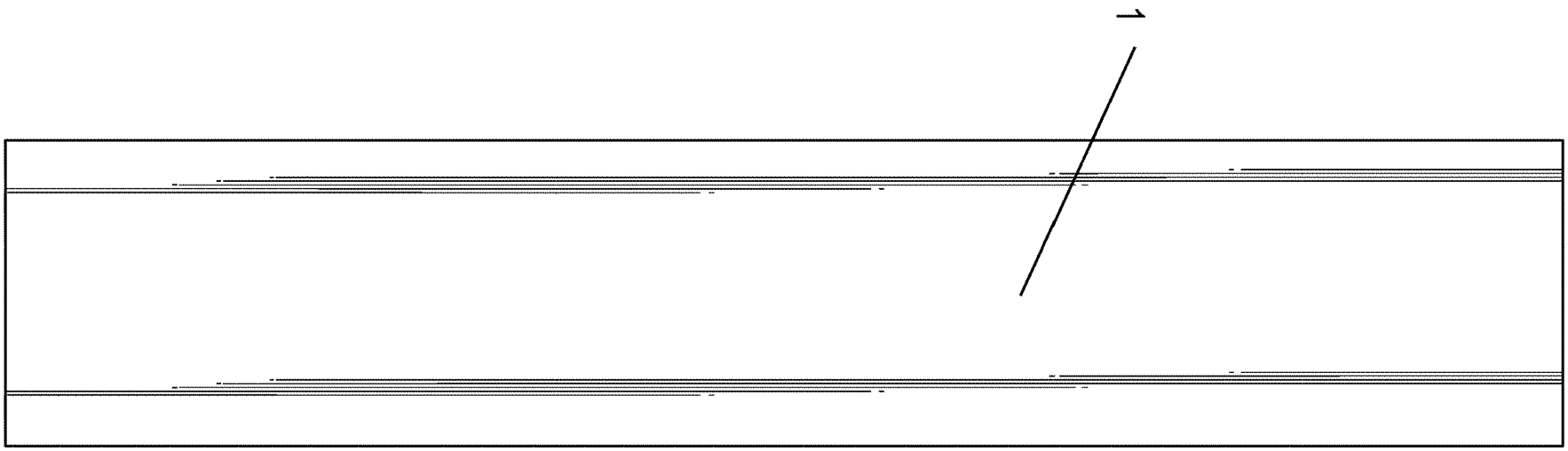
FIG. 5 is a right-side view thereof.
Figure 6:
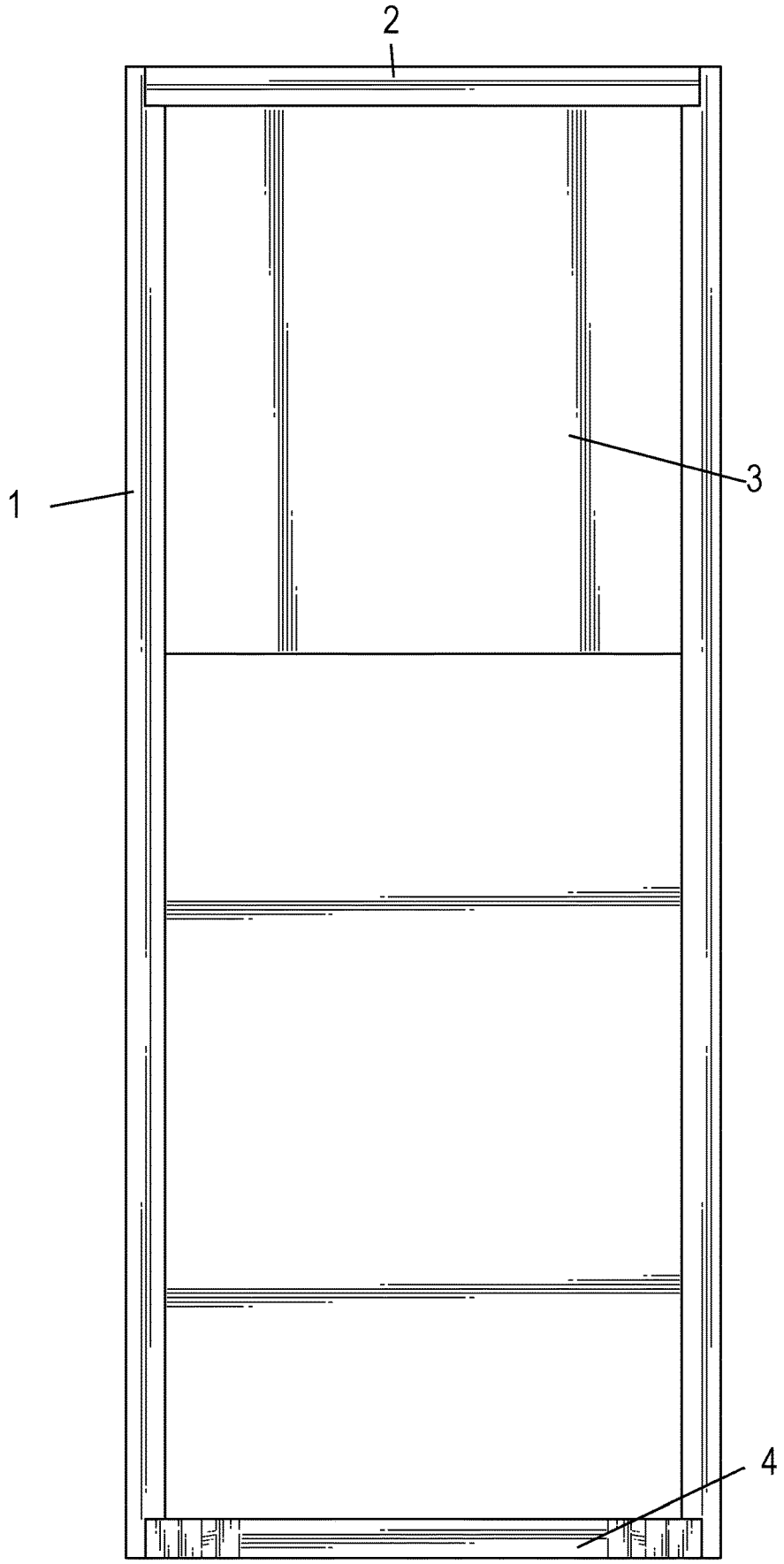
FIG. 6 is a top view thereof.
Figure 7:
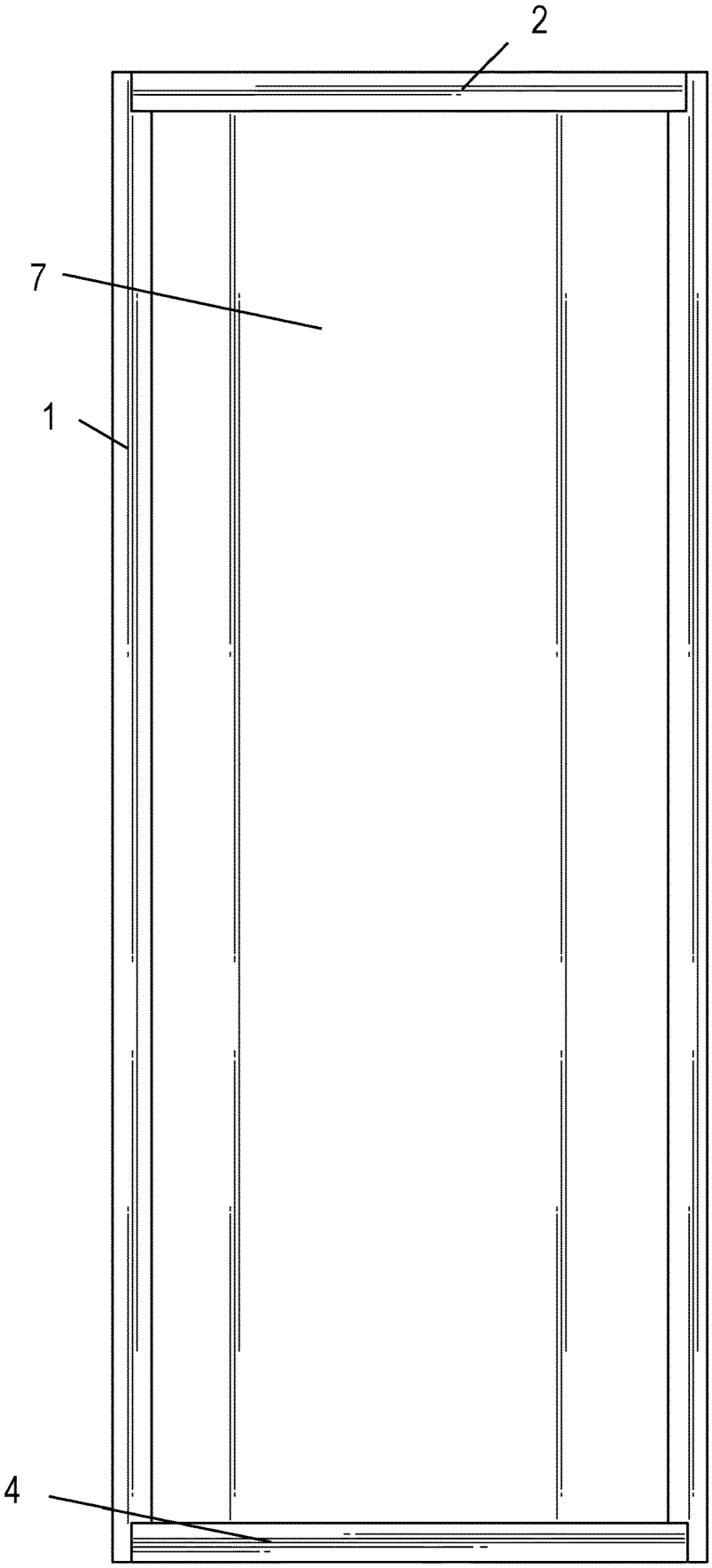
FIG. 7 is a bottom view thereof.

FIG. 1 is a perspective view of a horizontal knife holder.
FIG. 2 is a front view thereof.
FIG. 3 is a back view thereof.
FIG. 4 is a left-side view thereof.
FIG. 5 is a right-side view thereof.
FIG. 6 is a top view thereof.
FIG. 7 is a bottom view thereof.

The horizontal knife holder has two sides 1, a back 2, a bottom 7, a front 4 and a top 3. The front 4 has a scalloped portion 5. Underneath the top 3 is the holder 6, which is a series of plastic wire brush spines into which knifes are inserted. The holder 6 keeps the knives in place and prevents them from touching the bottom of the holder. It is commonplace for knives to be dumped in a drawer, where they can rattle and knock around every time the door is opened or closed. This leads to rapid dulling of the knives, which is why it is desirable to retain individual knives where they cannot dull adjacent knives.

The wire brush spines can be created from either plastic or metal, and can be inserted in a variety of ways. One embodiment calls for circular wire spines to be individually inserted into holes drilled in the back of the holder, and secured with a small drop of glue on the end of each. Another embodiment has the bristles glued into a plastic tray that is then glued or snapped into the back of the box, and is removable for cleaning. A diameter of approximately 2 mm is preferred, although a range of 1-4 mm is contemplated for holders designed for different sizes of knives. The wire brush spines can also have a square, triangular, rectangular, hexagonal or octagonal cross-sectional profile.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A device for holding knifes, comprising, a rectangular holder, wherein the rectangular holder comprises two sides, a back, a bottom, a front and a top, wherein the front has a scalloped portion, wherein under the top is a holder, wherein the holder comprises a series of wire brush spines into which one or more knives are inserted, wherein the wire brush spines are plastic, wherein the bottom additionally comprises a soft pad which protect a user's knuckles when the user is inserting the one or more knives, wherein the wire brush spines in the series of wire brush spines have a cross-sectional design, wherein the wire brush spines in the series of wire brush spines have a circular cross-sectional design, wherein one or more layers of wire brush spines in the series of wire brush spines have an offset organizational layout, with a first layer of wire brush spines offset from adjacent layers of wire brush spines, wherein the offset organizational layout provides an offset design wherein the first layer has each of a plurality of first layer wire brush spines located over a plurality of second layer gaps in between a plurality of second layer wire brush spines, and wherein each of the second layer wire brush spines is located over a plurality of third layer gaps in between a plurality of third layer wire brush spines, wherein each of the wire brush spines extends from a back connection point on the back of the rectangular holder to a location equal to a front section of the top.

2. The device of claim 1, wherein the scalloped portion of the front has two buttress portions, with two buttress curves extending the front in a downward direction, with two edge curves creating a flat entry point on the front, wherein one of more knives is inserted through the scalloped portion and into the series of wire brush spines.

3. The device of claim 2, wherein the series of wire brush spines retains the one or more knives and prevents the one or more knives from touching the bottom of the rectangular holder.

4. The device of claim 3, wherein each of the series of wire brush spines is inserted into a pre-drilled hole in the back of the rectangular holder.

5. The device of claim 4, wherein each of the series of wire brush spines is secured with a drop of glue on a back end of each of the series of wire brush spines.

6. The device of claim 5, wherein each of the series of wire brush spines has a diameter, and the diameter is between 1 mm and 4 mm.

7. The device of claim 6, wherein the diameter is approximately 2 mm.

* * * * *